United States Patent [19]

Longo

[11] 3,980,115

[45] Sept. 14, 1976

[54] GOLF CLUB SEPARATORS FOR GOLF BAG

[76] Inventor: Paul Longo, E. State & High Sts., Camden, N.J. 08105

[22] Filed: May 16, 1975

[21] Appl. No.: 578,088

[52] U.S. Cl. ..... 150/1.5 R
[51] Int. Cl.[2] ..... A63B 55/00
[58] Field of Search ..... 150/1.5 R, 1.5 C

[56] References Cited

UNITED STATES PATENTS

| | | | |
|---|---|---|---|
| 2,860,679 | 11/1958 | Kouke | 150/1.5 R |
| 2,938,559 | 5/1960 | Harkrader | 150/1.5 R |
| 3,101,108 | 8/1963 | Ingoldt | 150/1.5 R |
| 3,554,255 | 1/1971 | Mangan | 150/1.5 R |

*Primary Examiner*—Donald F. Norton
*Attorney, Agent, or Firm*—Weiser, Stapler & Spivak

[57] ABSTRACT

Club separators comprise a plurality of tubular members which are positioned within a golf bag. Upper and lower foam plastic spacers are compressed into the interior of the golf bag to retain the separators in predetermined axially aligned orientation.

4 Claims, 5 Drawing Figures

GOLF CLUB SEPARATORS FOR GOLF BAG

BACKGROUND OF THE INVENTION

The invention relates generally to the field of golf bag construction, and more particularly, is directed to golf club separators which may be applied to a finished golf bag.

The game of golf is extremely popular throughout the world and the game apparatus includes a plurality of variously configured golf clubs which are employed to drive a golf ball over a distance that is infinitely variable. As the players become more proficient in the sport, more and more clubs are generally employed to enhance accuracy and to increase the proficiency of the player. Quite often, the number of clubs carried by a player will number in the range of from ten to sixteen.

A golf bag is usually employed to carry the clubs and such bags usually define circular or obround interior spaces into which the clubs are placed. Golf bags have been fabricated with individual separators to form a separate compartment for each of the golf clubs used. Such bags are usually purchased by more advanced players to protect the clubs and to define separate storage areas within the golf bag for each of the golf clubs used.

In order to reduce initial manufacturing cost factors in fabricating golf bags with individual separators, prior workers in the art have developed methods of adding club separators to relatively inexpensive golf bags and to simulate the more expensive, factory made, golf bags with integral club separators. U.S. Pat. Nos. 3,729,036, 3,101,108, 3,164,185 and 3,554,255 are exemplary of prior art devices which have been previously designed.

SUMMARY OF THE INVENTION

This invention is directed to golf club separators for golf bags which may be easily installed into a wide variety of existing golf bags. The golf club separtors of the present invention include a plurality of hollow, tubular elements of size to receive a golf club shaft therein. The tubular elements are preferably fabricated of extruded plastic of sufficient strength and thickness to resist deformation when in use.

An upper and a lower spacer of a generally cylindrical configuration are provied with a plurality of openings which vertically align to receive and retain the hollow tubular elements therein. The spacers are fabricated of a resilient material such as foam plastic and employ the resilient qualities of the foam in a manner to permit easy installation within a previously manufactured golf bag without the need for any special skills or special tools.

It is therefore an object of the present invention to provide an improved golf club separator system for golf bags of the type set forth.

It is another object of the present invention to provide a novel golf club separator system which employs a plurality of hollow tubular plastic golf club holding members and resilient retainers to position and retain the separators within a golf bag.

It is another object of the present invention to provide a novel golf club separator system for golf bags which employs upper and lower tube retainers, the tube retainers being fabricated of foam plastic material which can be compressed to fit within a golf bag and wherein the natural memory of the foam material acts to retain the spacers and the tubular members within the golf bag interior.

It is another object of the present invention to provide a novel golf club separator system for golf bags including hollow tubular means to receive the individual golf clubs and resilient spacer means to retain the tubular means within the golf bag.

It is another object of the present invention to provide a novel golf club separator system for golf bags that is simple in design, rugged in construction and trouble free when in use.

Other objects and a fuller understanding of the invention will be had by referring to the following description and claims of a preferred embodiment thereof, taken in conjunction with the accompanying drawings wherein like reference characters refer to similar parts throughout the several views and in which:

DESCRIPTION OF THE PREFERRED EMBODIMENT OF THE INVENTION

Figure 1:
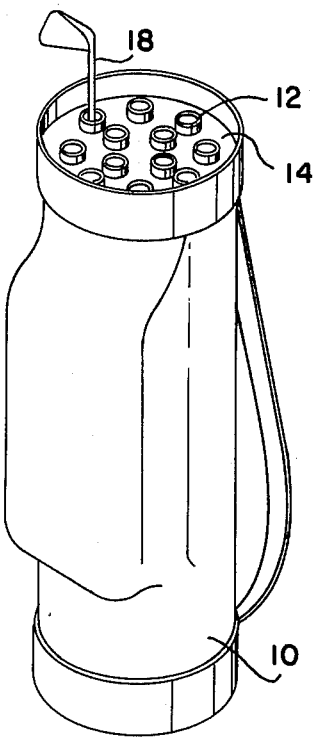
FIG. 1 is a perspective view showing the invention in use in a golf bag.

Although specific terms are used in the following description for the sake of clarity, these terms are intended to refer only to the particular structure of my invention selected for illustration in the drawings and are not intended to define or limit the scope of the invention.

Referring now to the drawings, I show in FIG. 1 a golf bag 10 of conventional design suitable for holding a plurality of golf clubs 18. In the embodiment illustrated, the golf bag 10 is illustrated in a generally round cross sectional configuration. Other cross sectional configurations such as oval, obround or the like are within the scope of this invention.

The golf club separator system of the present invention includes a plurality of hollow, tubular members 12 which are of suitable cross sectional dimensions to slidingly receive a shaft 20 of a conventional golf club 18. The tubular members 12 may be formed of any generally rigid material which may be formed to a hollow tubular configuration, for example, plastics such as polyethylene or polypropylene or lightweight metal such as aluminum. In the preferred embodiment, the tubular members 12 are fabricated of extruded polyethylene plastic of wall thickness sufficient to resist deformation. The tubular members are cut to a length sufficient to extend substantially from the bottom 22 of the golf bag 10 to the top 24 of the golf bag 10. Generally speaking, sufficient hollow tubular members 12 should be provided to accommodate all of the golf clubs 18 which are to be carried by the golfer. This number may vary between approximately ten and approximately sixteen and accordingly, the diameter of the tubular members should be designed to permit sufficient numbers of tubular members 12 to be applied interiorly of the golf bag 10.

Upper and lower spacer members 14, 16 are provided to retain the tubular members 12 in spaced, parallel arrangement in axial alignment with the longitudinal axis of the golf bag 10. The upper and lower spaces 14, 16 are preferably fabricated of a resilient material such as an expanded foam plastic having suitable characteristics to permit the material to be compressed as required to fit interiorly of the golf bag and having a memory to tend to return to its initial condition. Because of this memory, the spacers 14, 16 can be employed for tubular member securing purposes.

One suitable foam material which has been found satisfactory for the purpose is a foam plastic designated P-3500 and manufactured by Tenneco Chemicals. The P-3500 type foam is manufactured by reacting water, toluenediisocyanate, polypropylend-oxide-based triol in the presence of standard organic amine, tin catalysts and a poly (dimethylsiloxane) based surfactant. Other foam plastics or foam rubber materials which may be compressed as necessary to fit within a golf bag and to retain the tubular members 12 therein may also be employed and still fall within the scope of the invention.

Figure 2:
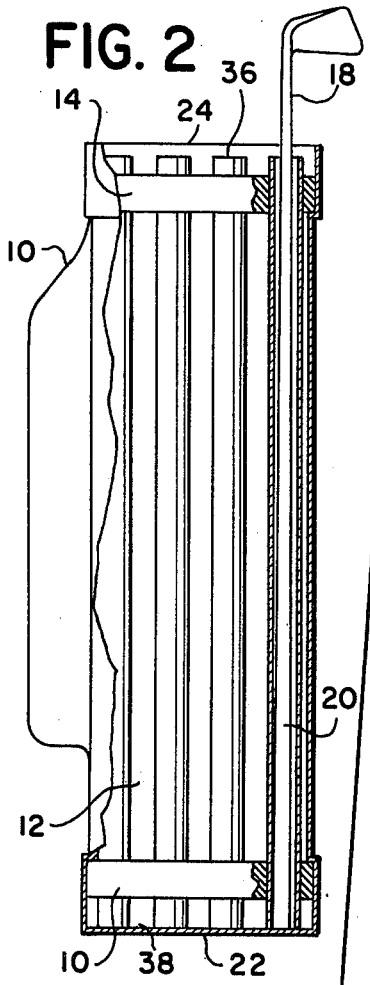
FIG. 2 is an enlarged, side elevational view of the device of FIG. 1, partially broken away to show details of interior construction.
Figure 3:
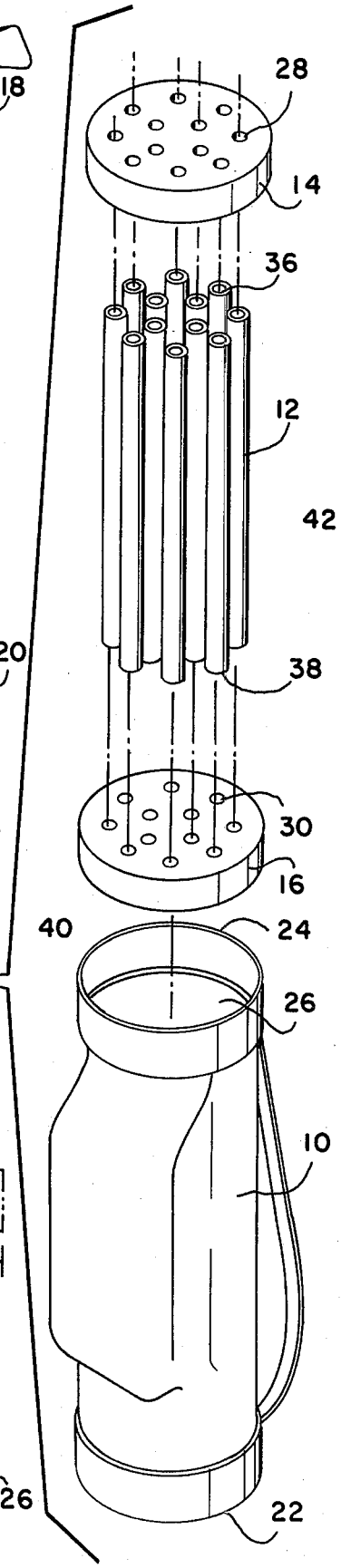
FIG. 3 is an exploded, perspective view of the interacting members of the system.
Figure 4:
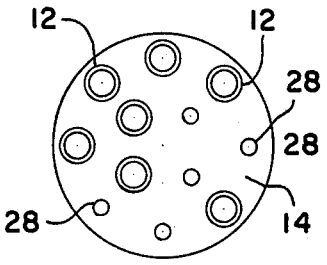
FIG. 4 is a top plan view of a spacer with certain of the tubular members applied thereto.

As best seen in FIGS. 3 and 4, the upper and lower spacers 14, 16 are formed to provide a plurality of vertical openings 28, 30 which are distributed about each spacer 14, 16 in vertical alignment to maintain the tubular members 12 in vertical, axially aligned relationship within the golf bag 10 when in use. See FIG. 2. As best seen in FIG. 4, each of the openings 28 is fabricated to a diameter that is considerably smaller than the outside diameter of the tubular members 12, for example, in the order of a ratio of one to two. Thus, in order to apply a tubular member 12 to the spacer 14 or 16, it is necessary to force the tubular member 12 into an opening 28 to thereby stretch or deform the foam material of the spacer to expand the opening 28 sufficiently to allow a portion of the tubular member to pass therethrough. As above set forth, the foam material comprising the upper and lower spacers 14, 16 must possess a natural memory so that the material continuously seeks to return to its initial condition. The forces generated at each opening 28 act in a radial direction with sufficient force to prevent the tubular members 12 from slipping vertically relative to the upper and lower spacers 14, 16 due to frictional engagement. Accordingly, once the tubular members 12 have been applied through the openings 28, 30 of the spacers 14, 16, the parts cannot be easily dissociated, but rather, conscious effort must be made to disengage the cooperating parts.

Figure 5:
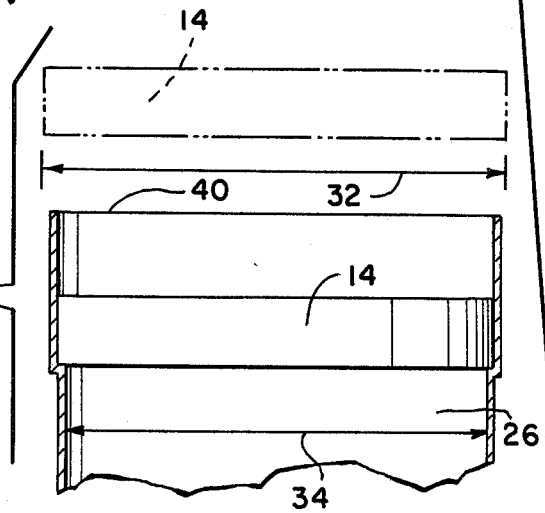
FIG. 5 is a partial, enlarged, cross sectional view of the top of the golf bag. The dotted line representation shows a spacer in exploded relationship in uncompressed condition.

As illustrated in FIG. 5, each of the upper and lower spacers (only spacer 14 being illustrated) are fabricated to a cross sectional diameter (as indicated by the arrow 32) which is greater than the interior cross sectional diameter (as illustrated by the arrow 34) of the golf bag 10. In order to apply the spacers 14, 16 within the interior 26 of the golf bag 10, the spacers must be compressed radially inwardly sufficiently (to be smaller than the diameter 34) to allow the spacers to be introduced interiorly of the golf bag construction. As above indicated, the foam material comprising the spacers 14, 16 must have a natural memory to return to its initial condition. Accordingly, after the spacers 14, 16 have been compressed radially inwardly and have been positioned interiorly of the golf bag 10, then the natural memory of the foam material pushes radially outwardly against the interior surfaces of the golf bag. This action tends to positively engage the spacers in a desired interior position, for example, one near the golf bag top 24 and the other near the golf bag bottom 22. See FIG. 2.

In order to use the golf club separator system of the present invention, the tubular members 12 are forced respectively into the openings 28 of the upper spacer 14 and the openings 30 of the lower spacer 16 by expanding or stretching the openings 28, 30 as necessary to accommodate the wider cross sectional dimensions of the tubular members 12. The tubular members 12 are positioned relative to the upper and lower spacers 14, 16 so that all of the upper and lower hollow tubular member ends 36, 38 project through the respective spacers 14, 16 a substantially equal distance, for example approximately one to five inches. After the upper and lower spacers 14, 16 have been properly positioned relative to the respective tops and bottoms 36, 38 of the tubular members and all of the tubular members have been secured by forcing them through the respective spacer openings 28, 30, the entire bundle comprising the combination of the plurality of tubular members 12, the upper spacer 14 and the lower spacer 16 is then axially applied at the top opening 40 of the golf bag 10. The outer periphery of the lower spacer 16 is first radially inwardly compressed sufficiently to be equal to or smaller than the inner diameter 34 of the golf bag. The spacers 14, 16 and the attached tubular members 12 are then applied vertically downwardly in the direction of the arrow 42 until the top spacer 14 approaches the open top 40 of the golf bag 10. The top spacer 14 is then also pressed radially inwardly a sufficient distance to permit the upper spacer 14 to be pushed downwardly relative to the top opening 40. The parts are continuously urged downwardly in the direction of the arrow 42 until the respective bottoms 38 of the tubular members 12 position against the golf bag bottom 22 which thereby defines the lower limit of travel. The natural memory of the foam construction of the upper and lower spacers 14, 16 continuously urges the spacers to return to their initial condition to thereby set up sufficient frictional forces within the interior 26 of the golf bag 10 to retain the spacers and their affixed tubular members interiorly of the golf bag under all normal conditions of use.

I claim:

1. In a golf club separator system for an existing golf bag of the type defining an elongated interior space, the combination of a plurality of tubular members positioned within the golf bag interior space;

a resilient, compressible upper spacer positioned within a golf bag interior space and being provided with a plurality of openings, at least some of the said tubular members being positioned within the spacer openings;

resilient means to retain the spacer within the interior of the golf bag;

means to retain the tubular members within the openings of the spacer; and resilient means to retain the tubular members in parallel relationship within the golf bag.

2. The system of claim 1 wherein the resilient means comprise a lower spacer, said lower spacer being of resilient, compressible material, said lower spacer being spaced from the upper spacer to maintain the parallel orientation of the tubular members.

3. The system of claim 2 wherein the upper and lower spacers are fabricated of resilient, foam material and wherein the means to retain the tubular members within the openings of the spacer comprise the bias of the spacer material against the tubular members.

4. The system of claim 3 wherein the upper spacer is positioned near the top of the golf bag and the lower spacer is positioned near the bottom of the golf bag.

* * * * *